US012674258B2

(12) United States Patent
Capt et al.

(10) Patent No.: US 12,674,258 B2
(45) Date of Patent: Jul. 7, 2026

(54) MACHINE FOR SEWING, EMBROIDERY OR QUILTING

(71) Applicant: BERNINA International AG, Steckborn (CH)

(72) Inventors: Alain Capt, Steckborn (CH); Daniel Rupp, Felben-Wellhausen (CH); Roland Beer, Weinfelden (CH)

(73) Assignee: BERNINA International AG, Steckborn (CH)

( * ) Notice: Subject to any disclaimer, the term of this patent is extended or adjusted under 35 U.S.C. 154(b) by 0 days.

(21) Appl. No.: 19/201,166

(22) Filed: May 7, 2025

(65) Prior Publication Data

US 2025/0347043 A1 Nov. 13, 2025

(30) Foreign Application Priority Data

May 8, 2024 (CH) ..... 000517/2024
Oct. 24, 2024 (CH) ..... 001165/2024

(51) Int. Cl.
*D05B 69/36* (2006.01)
*D05B 55/00* (2006.01)
*D05B 69/30* (2006.01)

(52) U.S. Cl.
CPC ..... *D05B 69/36* (2013.01); *D05B 55/00* (2013.01); *D05B 69/30* (2013.01)

(58) Field of Classification Search
CPC ..... D05B 69/36; D05B 69/30; D05B 19/12; D05B 19/14; D05B 19/16; D05B 21/00
See application file for complete search history.

(56) References Cited

U.S. PATENT DOCUMENTS 4,534,304 A * 8/1985 Reinke ..... D05B 69/20 112/315
4,548,143 A 10/1985 Martell et al.
4,612,867 A 9/1986 Rosch et al.
4,901,660 A 2/1990 Takeuchi et al.
6,450,110 B1 * 9/2002 Bruhl ..... D05B 47/04 112/315
6,871,606 B2 3/2005 Schweizer
6,883,446 B2 4/2005 Koerner
6,959,657 B1 11/2005 Duval
(Continued)

FOREIGN PATENT DOCUMENTS

WO 2004072349 A2 8/2004
WO 2006071786 A2 7/2006
WO 2007143062 A2 12/2007

*Primary Examiner* — Danny Worrell
(74) *Attorney, Agent, or Firm* — Volpe Koenig

(57) ABSTRACT

A machine (M) for sewing, embroidering or quilting, in which a flat section (T1) of a textile structure (T) in a stretched state can be pressed against a textile structure support area (TA) adjacent to a stitch plate (SP) and/or against the stitch plate (SP) and moved in a plane parallel to the stitch plate (SP) at a speed (v) relative to the stitch plate (SP) so that the flat section (T1) lies flat against the stitch plate (SP). The machine (M) contains a detector module (DM) with which a property and/or a state of the moved flat section (T1) of the textile structure (T) can be detected, and a control unit (SE) with which an operating mode of the machine (M) can be adjusted depending on the detected property or the detected state of the moved flat section (T1) of the textile structure (T).

18 Claims, 11 Drawing Sheets

(56) References Cited

U.S. PATENT DOCUMENTS

| | | | | |
|---|---|---|---|---|
| 7,325,502 | B2 | 2/2008 | Koenig et al. | |
| 7,373,891 | B2 | 5/2008 | Koerner | |
| 8,037,834 | B2 | 10/2011 | Shimizu et al. | |
| 8,082,866 | B2 * | 12/2011 | Hirose | D05C 5/06 112/470.03 |
| 8,573,145 | B2 | 11/2013 | Dickerson | |
| 9,115,451 | B2 | 8/2015 | Konzak et al. | |
| 9,315,933 | B1 * | 4/2016 | Martelli | D05B 19/16 |
| 9,840,797 | B2 | 12/2017 | Schwarzberger et al. | |
| 10,240,270 | B2 * | 3/2019 | Schwarzberger | D05B 19/14 |
| 10,767,292 | B2 | 9/2020 | Imano et al. | |
| 11,015,276 | B2 | 5/2021 | Konzak | |
| 11,926,943 | B2 * | 3/2024 | Takei | D05B 29/12 |
| 2005/0145149 | A1 | 7/2005 | Hooke | |
| 2006/0015209 | A1 | 1/2006 | Schweizer | |
| 2006/0283366 | A1 | 12/2006 | Durville et al. | |
| 2007/0221108 | A1 * | 9/2007 | Koerner | D05B 11/00 112/119 |
| 2017/0073864 | A1 * | 3/2017 | Nakajima | D05B 69/00 |
| 2024/0384453 | A1 | 11/2024 | Akahane et al. | |

* cited by examiner

MACHINE FOR SEWING, EMBROIDERY OR QUILTING

CROSS-REFERENCE TO RELATED APPLICATIONS

This application claims priority to Swiss Patent Application No. CH000517/2024, filed May 8, 2024, and Swiss Patent Application No. CH001165/2024, filed Oct. 24, 2024, both of which are incorporated herein by reference as if fully set forth.

TECHNICAL FIELD

The invention relates to a machine for sewing, embroidering or quilting, hereinafter also referred to simply as "machine".

BACKGROUND

Such a machine has a needle bar arranged above a stitch plate, which can be moved up and down and to which a needle is attached, which has an eye for receiving an upper thread.

The machine also has a rotatable or reciprocating gripper system, also referred to as a hook system, arranged below the stitch plate, to which a gripper, also referred to as a hook, is attached, which has a gripper tip or hook for picking up the upper thread.

The stitch plate contains an opening/recess for the needle and the eye to pass through the stitch plate from top to bottom and back.

During sewing, embroidering or quilting, a flat section of a textile fabric can be pressed in a stretched state against a textile fabric support area adjacent to the stitch plate and/or against the stitch plate and moved in a plane parallel to the stitch plate at a speed relative to the stitch plate, so that the flat section lies flat against the stitch plate.

During sewing, embroidering or quilting, a textile fabric moved along the stitch plate may have different properties and/or states in the area of the opening/recess over time. This can be caused, for example, by irregularities in the structure of the textile fabric (weaving faults, damage) or irregularities in the type of movement of the textile fabric (uneven speed, crease-like or wave-like deformation).

Such irregularities, which are generally undesirable, impair the result of sewing, embroidering or quilting.

SUMMARY

It is an object of the invention to prevent or at least reduce such impairments occurring during sewing, embroidering or quilting.

Therefore, the invention provides a machine (M) for sewing, embroidering or quilting, which comprises: a needle bar (NS) arranged above a stitch plate (SP) and movable up and down and to which needle bar a needle (N) is attached, which has an eye for receiving an upper thread; —a rotatable or reciprocating gripper system (GS) arranged below the stitch plate (SP) and to which gripper system a gripper is attached, which has a gripper tip for engaging the upper thread; wherein the stitch plate (SP) contains an opening/recess (A0) for the needle (N) and the eye to pass through the stitch plate (SP) from top to bottom and back; and wherein a flat section (T1) of a textile structure (T) in a stretched state can be pressed against a textile structure support area (TA) adjacent to the stitch plate (SP) and/or against the stitch plate (SP) and moved in a plane parallel to the stitch plate (SP) at a speed (v) relative to the stitch plate (SP), so that the flat section (T1) lies flat against the stitch plate (SP).

The machine (M) according to the invention also comprises: a detector module (DM) with which a property and/or a state of the moved flat section (T1) of the textile structure (T) can be detected; and—a control unit (SE) with which an operating mode of the machine (M) can be adjusted depending on the detected property or the detected state of the moved flat section (T1) of the textile structure (T).

The needle bar (NS) is part of a sewing head or an "upper thread assembly" which provides an upper thread for sewing, embroidering or quilting.

The gripper system (GS) is part of a "lower thread assembly" which provides a lower thread and brings the upper thread together with the lower thread during sewing, embroidering or quilting.

By adjusting the operating mode of the machine in accordance with the invention, the above-mentioned irregularities, which usually lead to a deterioration in the sewing, embroidery or quilting result, can be compensated for, thereby avoiding or reducing the deterioration.

Preferably, the detector module (DM) is arranged in an area below the needle plate and/or flush with the upper surface of the needle plate (SP), with the detector module (DM) preferably arranged next to the gripper system (GS).

As a result, the working area above the needle plate, apart from the needle moving up and down, is free of obstacles in the immediate vicinity of the needle. This facilitates visibility and largely unimpeded movement of the textile structure by the machine operator's hands. In contrast to other areas below the stitch plate, which have several mechanical machine components, the area next to the gripper system (GS) offers a relatively large amount of free space.

Preferably, a detector module control unit (SE1) and a further control unit or regulating unit, in particular a lower thread monitoring unit (SE2), are arranged on a common circuit board (GP).

As a result, no additional installation space is required for the detector module control unit (SE1), which contributes to the compactness of the detector module (DM).

The detector module (DM) can be used to detect a property, in particular a fabric structure or a color structure, an end or an edge, a bulge, a fabric defect or damage to the fabric on the one hand, or a speed and a deformation, e.g. an increase due to compression, of the moving flat section (T1) of the textile structure (T) can be detected.

This allows the control unit to adjust a suitable operating mode of the machine (M) depending on such detected properties or states of the moved flat textile structure (T).

Preferably, the detector module control unit (SE1) can be used to at least stop the machine, in particular with the needle (N) at the top or with the needle (N) in the textile structure (T), or to adjust a stitch frequency (f) of the needle (N) depending on the nature, in particular the fabric structure or the color structure, the end or edge, the bead, the fabric defect or the fabric damage, or the speed of the moved flat section (T1) of the textile structure (T).

Stopping the machine with the needle at the top allows the textile structure to be moved or removed from the stitch plate, while stopping the machine with the needle in the textile structure allows the textile structure to be rotated around the needle.

Preferably, the needle stitch frequency (f) can be adjusted to the speed or the speed value (v) in such a way that the current needle stitch frequency (f) is essentially proportional to the current speed or the current speed value (v).

This ensures that the sewing, embroidery or quilting product has a uniform stitch length even if the textile structure moves at an uneven speed during sewing, embroidering or quilting.

Preferably, a proportionality factor between the needle stitch frequency (f) and the speed (v) can be adjusted.

This adjustability allows products with small and large stitch lengths to be produced without changing the speed of movement of the textile structure during sewing, embroidering or quilting. This adjustability also makes sewing, embroidering or quilting easier for beginners.

Preferably, the detector module (DM) contains the following components: on the one hand, an E/M source (EMQ) that can emit an electromagnetic signal (S1) which can pass through the stitch plate (SP) at a first passage area (DB1) of the stitch plate (SP) to a lower side of the flat section (T1) of the textile structure (T) facing the stitch plate and can be emitted onto the lower side of the flat section (T1), in order to generate an electromagnetic return signal (S2) reflected or scattered back from the underside of the moved flat section (T1); and on the other hand, an E/M sensor (EMS) which can absorb the electromagnetic return signal (S2) reflected or scattered back from the underside of the moved flat section (T1) which can pass through the stitch plate (SP) at the first passage area (DB1) or at a second passage area (DB2) of the stitch plate (SP) to the E/M sensor (EMS).

The use of electromagnetic waves or rays as signals or information carriers for detecting information, on the one hand, about a property, in particular a fabric structure or a color structure, an end or an edge, a bulge, a fabric defect or fabric damage of the moved textile structure or, on the other hand, about a speed or a deformation, e.g. an elevation due to compression, of the moved flat section (T1) of the textile structure (T) is particularly advantageous, since electromagnetic waves can carry several types of information.

For example, different types of information about the moved textile structure can be obtained by selecting the frequency or wavelength and/or the depth of field of the waves/rays.

In addition, by clocking (repeatedly switching on and off) the E/M source, information about the state of movement, in particular the horizontal speed and the vertical speed of the deformation of the moved textile structure, can be captured in the signal.

Preferably, at least one first beam deflection means (SA1) is arranged as a component of the detector module (DM) in a forward propagation path (PF1) of the forward signal (S1) extending from the E/M source (EMQ) to the underside of the flat section (T1).

Preferably, at least one second beam deflection means is arranged in a similar manner in a return propagation path (PF2) of the return signal (S2) extending from the underside of the flat section (T1) to the E/M sensor (EMS) as a component of the detector module (DM).

The use of a beam deflection means in the forward propagation path and/or in the return propagation path allows great flexibility in the integration of the detector module and its components in complicated and confined installation environments of the machine below its stitch plate.

Preferably, the return propagation path (PF2) is designed to be telecentric on the object side or relative to the plane of the textile structure (T).

As a result, the magnification remains constant during optical imaging of the illuminated flat section (T1) of the textile structure (T), even if the distance between the textile structure and the stitch plate varies, e.g. if the textile structure is raised due to compression. This increases the robustness of the detection of a property and/or a state of the moved flat section (T1) of the textile structure (T) by the detector module (DM).

Preferably, the first beam deflection means (SA1) is designed such that it can direct a minimum proportion, in particular more than 20%, and preferably a large proportion, in particular more than 80%, of the energy of the forward signal (S1) onto the underside of the flat section (T1).

Such a beam deflecting means acting as a beam splitter in the forward propagation path makes it possible to direct a first part of the forward signal emitted by the E/M source onto a first section or first sub-area of the moving flat section (T1) of the textile structure (T), and to direct a second part of the forward signal emitted by the E/M source onto a second section or second sub-area of the moving flat section (T1) of the textile structure (T). In this way, more differentiated information about the moved flat section of the textile structure can be obtained.

Preferably, the second beam deflecting means is designed in a similar manner so that it can direct a minimum proportion, in particular more than 20%, and preferably a large proportion, in particular more than 80%, of the energy of the return signal (S2) toward the E/M sensor (EMS).

Such a beam deflecting means acting as a beam splitter in the return propagation path makes it possible to direct a first part of the forward signal reflected or scattered by the moved flat section (T1) of the textile structure (T) to a first E/M sensor (EMS) and a second part of the forward signal reflected or scattered by the moved flat section (T1) of the textile structure (T) to a second E/M sensor (EMS). The first E/M sensor and the second E/M sensor may be identical or different. Such redundancy in the detector module increases its robustness.

Preferably, the second beam deflecting means in the return propagation path can map the return signal (S2) reflected or scattered by the underside of the moved flat section (T1) onto the E/M sensor (EMS), wherein image points on the E/M sensor (EMS) correspond to respective scattering object points on the underside of the flat section (T1).

This enables repeated acquisition of two-dimensional images, i.e., snapshots, of the movement of the moved flat section, from which, as mentioned above, information can be obtained on the one hand about a property and on the other hand about a speed and a deformation of the moved flat section (T1) of the textile structure (T).

Preferably, the E/M source (EMQ) can emit an optical signal (S1) in the UV range, visible range, or IR range, and the E/M sensor (EMS) can absorb a corresponding optical signal (S2) in the UV range, visible range, or IR range.

A light-emitting diode and/or a laser diode can be used as the E/M source.

Preferably, a laser diode is used which emits coherent radiation, whereby a speckle pattern is produced on the illuminated surface of the textile structure even with a very smooth surface (coated textile structure), which also provides a high contrast or a high-contrast pattern even with a smooth surface.

An optical CCD sensor or an optical CMOS sensor, preferably containing a built-in image processing unit, can be used as the E/M sensor. The processing unit calculates the direction and magnitude of the speed of movement of the textile structure along the stitch plate from the differences between successive images of the moved textile structure.

The use of optical frequencies or wavelengths ensures a resolution that is suitable for detecting both structural properties and movements of textile structures.

It is advantageous for the at least one first beam deflecting means (SA1) to contain at least one of the following components along the forward propagation path (PF1): a converging lens, a diverging lens, a converging mirror, a diverging mirror, a deflection mirror, a deflection prism, a beam splitter.

It is advantageous for the at least one second beam deflecting means to contain at least one of the following components along the return propagation path (PF2): a converging lens, a diverging lens, a converging mirror, a diverging mirror, a deflection mirror, a deflection prism, a beam splitter.

This allows the detector module to be designed to suit the respective installation environment of the machine using a suitable component. Preferably, only one or two such components are used together with the E/M source.

The forward propagation path (PF1) and the reverse propagation path (PF2) can be identical or congruent at least along a common section along the forward propagation path (PF1) and along the reverse propagation path (PF2), whereby the forward signal (S1) can pass through the common section in a first direction and the reverse signal (S2) can pass through the common section in a second direction opposite to the first direction. In other words, a section of the forward propagation path (PF1) extending along the forward propagation path (PF1) and a section of the return propagation path (PF2) extending along the return propagation path (PF2) can be identical.

This contributes to the compactness of the detector module.

The at least one first beam deflecting means (SA1) and the at least one second beam deflecting means can be identical in design or can be formed by a single beam deflecting means which is traversed by the forward signal (S1) in a first direction and by the return signal (S2) in a second direction, in particular opposite to the first direction.

This also contributes to the compactness of the detector module.

The first passage area (DB1) and the second passage area (DB2) of the textile structure support area (TA) adjacent to the stitch plate (SP) and/or of the stitch plate (SP) can be arranged at two different locations.

This makes it possible to direct a first part of the forward signal emitted by the E/M source to a first section or first sub-area of the moved flat section (T1) of the textile structure (T) and a second part of the forward signal emitted by the E/M source to a second section or second sub-area of the moved flat section (T1) of the textile structure (T). As a result, more differentiated information about the entire moved flat section of the textile structure can also be obtained here.

Alternatively, the first passage area (DB1) and the second passage area (DB2) of the textile structure support area (TA) adjacent to the stitch plate (SP) and/or of the stitch plate (SP) may be identical or congruent.

Again, this contributes to the compactness of the detector module.

Preferably, the distance measured along the upper surface of the textile structure support area (TA) and/or of the stitch plate (SP) between the opening/recess (A0) for the passage of the needle (N) and a passage area (DB1, DB2) is less than 30 mm, preferably less than 25 mm, more preferably less than 20 mm, and most preferably less than 15 mm.

This ensures that the detected property and/or the detected state of the moved flat section (T1) of the textile structure (T) corresponds as closely as possible to the actual property and/or the actual state of the moved flat section (T1) of the textile structure (T) below the needle (N).

This also allows the control unit (SE), which adjusts the operating mode of the machine (M) depending on the detected property or state of the moving flat section (T1) of the textile structure (T), to carry out this adjustment based on information about the textile structure at the relevant location, practically below the needle.

Preferably, a passage area (DB1 and/or DB2) is located between two adjacent rows of feeders/conveyors or feed dogs (TR1, TR2, TR3) of the stitch plate (SP).

In this case, the distance defined above between the opening/recess (A0) for the passage of the needle (N) and a passage area (DB1, DB2) can be less than 15 mm or even less than 10 mm.

In a special embodiment, a passage area (DB1, DB2) and the opening/recess (A0) for the passage of the needle (N) are identical or congruent.

In this case, the distance defined above between the opening/recess (A0) for the passage of the needle (N) and a passage area (DB1, DB2) may even be significantly less than 10 mm.

This makes it possible for the detected property and/or the detected state of the moved flat section (T1) of the textile structure (T) to correspond very well to the actual property and/or the actual state of the moved flat section (T1) of the textile structure (T) below the needle (N). The detected property and/or the detected state of the moved flat section (T1) of the textile structure (T) on the one hand and the actual property and/or the actual state of the moved flat section (T1) of the textile structure (T) below the needle (N) on the other hand are then practically identical.

The first passage area (DB1) and/or the second passage area (DB2) can be formed by an opening in the textile structure support area (TA) adjacent to the stitch plate (SP) and/or in the stitch plate (SP) which is permeable to the first signal (S1) and to the second signal (S2).

This allows the respective signal to pass unimpeded through the textile structure support area (TA) adjacent to the stitch plate (SP) and/or through the stitch plate.

Alternatively, the first passage area (DB1) and/or the second passage area (DB2) can be formed by a window in the textile structure support area (TA) adjacent to the stitch plate (SP) and/or in the stitch plate (SP) which window is permeable to the first signal (S1) and to the second signal (S2).

This has the advantage that no particles can penetrate into the installation space containing the detector module below the stitch plate. Such particles are, for example, foreign bodies or impurities adhering to the textile structure and carried along by it, or abrasion originating from the fibers of the textile structure.

Preferably, the textile structure support area (TA) adjacent to the stitch plate (SP) and/or the stitch plate (SP) may also be formed from a material that is permeable to the first signal (S1) and the second signal (S2).

Preferably, the permeable window or the permeable material is made of a scratch-resistant material such as glass ($SiO_2$), sapphire ($Al_2O_3$) or a polymer, in particular a polyacrylate, e.g. with hard nanoparticles distributed therein, in particular made of glass or sapphire.

The first passage area (DB1) and/or the second passage area (DB2) may contain a beam deflecting means (SA1), wherein the beam deflecting means in particular has one of the following components or is formed as such a component: a converging lens, a diverging lens, a deflection prism, a beam splitter.

This functionalization of a passage area also contributes to the compactness of the detector module.

Preferably, the detector module (DM) has a housing (G) in which the components of the detector module (DM) are arranged or which surrounds the components of the detector module, the components being preferably fixed in the housing.

Similar to what was described above, this has the advantage that practically no particles can penetrate the detector module, such as foreign bodies or contaminants adhering to the textile structure and carried along by it, or abrasion originating from the fibers of the textile structure.

In addition, such a housing protects the components of the detector module from damage caused by external mechanical influences, such as penetrating buttons, needles, scissors, knives, etc., or fragments thereof.

Preferably, the forward propagation path (PF1) and/or the backward propagation path (PF2) contains a baffle or a diaphragm with an aperture.

A field aperture, in particular a field of view aperture and/or a light field aperture, and/or a stray light aperture may be included in the forward propagation path (PF1) and/or in the return/backward propagation path (PF2).

A baffle or diaphragm in the forward propagation path can be used to determine a cross-sectional area of the forward propagation path extending transversely to the optical axis or the degree of illumination or the size of the illuminated area on the underside of the flat section of the textile structure. This prevents additional areas inside the detector module from being illuminated other than from the moved textile structure which would generate additional disturbing stray light (extraneous stray light), which would enter the E/M sensor and thus increase the proportion of noise in the return signal reflected or scattered by the textile structure.

With a baffle or diaphragm in the return propagation path, any disturbing scattered light (residual stray light) that still occurs despite the baffle or diaphragm in the forward propagation path can be intercepted so that it does not enter the E/M sensor.

The baffle or diaphragm with aperture in the return propagation path increases the depth of field of the imaging by means of the reflected or scattered electromagnetic return signal (scattered light) on the E/M sensor (EMS). This means that object points on the underside of the flat section (T1) of the textile structure (T) which protrude in one direction or the other (downwards or upwards) from the image plane running parallel to the (horizontal) stitch plate due to local deformation of the textile structure can still be imaged relatively sharply on the E/M sensor. This means that properties and/or states of the moved flat section (T1) of the textile structure (T) are still detected even if the flat section (T1) of the textile structure (T) is not pressed completely against the stitch plate (SP) in the ideal stretched state.

If the machine has a conveyor or feed dog with at least two conveyor rows or feed dog rows (TR1, TR2, TR3), the housing is preferably arranged between two adjacent conveyor rows (TR1, TR2, TR3).

This also contributes to the compactness of the detector module.

Preferably, the forward propagation path (PF1) and the backward propagation path (PF2) pass through an optical capsule (OK) or an optical block.

By using an optical capsule OK or an optical block, all passive optical elements crossed by the two light propagation paths can be arranged in fixed relative positions to each other. Therefore, no adjustment of the passive optical elements is necessary.

Preferably, the optical capsule (OK) or the optical block contains at least one lens (L1, L2) and at least one beam deflecting means (SA1).

The optics formed in this way enable, on the one hand, illumination of the flat section T1 of the underside of the textile structure T by the E/M source EMQ via the forward propagation path PF1 and, on the other hand, optical imaging of object points of the flat section T1 of the underside of the textile structure T via the return propagation path PF2 onto image points on the E/M sensor EMS.

Preferably, the optical block is a monoblock made of light-transmissive material, preferably glass or polymer, wherein the at least one beam deflection means (SA1) is preferably a totally reflective interface between the light-transmissive material of the monoblock and the atmospheric air, and the at least one lens (L1, L2) is preferably a curved surface of the monoblock made of light-transmissive material.

Preferably, the optical capsule (OK) or the optical block is arranged in the housing (G), wherein the optical capsule (OK) or the optical block is preferably fixed in the housing (G).

Preferably, both the E/M source EMQ and the E/M sensor EMS are fixedly arranged on the common circuit board GP at defined locations in a defined orientation.

Preferably, the common circuit board GP is fixedly arranged on the housing G at a defined location and in a defined orientation.

Preferably, the optical capsule OK or the optical block is fixed to the housing G at a defined location and in a defined orientation.

These respective arrangements at a defined location and in a defined, fixed orientation result in a robust optical system and thus a robust detector module DM consisting of an E/M source EMQ, an E/M sensor EMS, and passive optical elements.

The invention also provides a method for sewing, embroidering or quilting, in particular using a machine defined in the preceding paragraphs, which comprises:

a) moving up and down a needle bar (NS) arranged above a stitch plate (SP), to which a needle (N) is attached, which has an eye with an upper thread received therein, wherein the needle (N) and the eye with the upper thread are repeatedly moved from top to bottom and back through an opening/recess (A0) through the stitch plate (SP);

b) simultaneously and synchronized with the upward and downward movement of the needle bar (NS), rotating or reciprocating a gripper system (GS) arranged below the stitch plate (SP) and to which a gripper is attached, which has a gripper tip, wherein the gripper system (GS) provides a lower thread and wherein the gripper picks up the upper thread with the gripper tip and brings it together with the lower thread; and c) simultaneously moving a flat section (T1) of a textile structure (T) in a stretched state and pressed against a textile structure support area (TA) adjacent to the stitch plate (SP) and/or against the stitch plate (SP) in a plane parallel to the stitch plate (SP) at a speed (v) relative to the stitch plate (SP), so that the flat section (T1) lies flat against the stitch plate (SP), wherein stitches joining the upper thread and the lower thread are formed on the textile structure (T);

d) detecting a property and/or a state of the moved flat section (T1) of the textile structure (T) by means of a detector module (DM); and e) adapting an operating mode of the machine (M) as a function of the detected property or the detected state of the moved flat section (T1) of the textile structure (T) by means of a control unit (SE).

By adjusting the operating mode of the machine in accordance with the invention, the above-mentioned irregularities, which generally lead to a deterioration in the sewing, embroidering or quilting result, can be compensated for, thereby avoiding or reducing the deterioration.

Preferably, the detector module (DM) detects both a property and a state of the moved flat section of the textile structure (T), and an operating mode of the machine (M) is adjusted by the control unit (SE) depending on both the detected property and the detected state of the moved flat section (T1) of the textile structure (T).

By taking into account both a property, i.e. an inherent characteristic of the textile structure, and a state, i.e. a characteristic of the textile structure resulting from the sewing, embroidering or quilting performed, impairments occurring during sewing, embroidering or quilting can be avoided or reduced even more effectively.

Preferably, the detected property of the moved flat textile structure (T) has at least one of the following aspects: a texture, in particular a fabric structure or a color structure, an end or an edge, a bulge, a fabric defect or damage to the textile structure (T).

Preferably, the detected state of the moving flat textile structure (T) has at least one of the following aspects: a speed, in particular parallel to the plane of the stitch plate, a deformation, in particular orthogonal to the plane of the stitch plate.

Preferably, the detector module control unit (SE1) causes at least one machine stop, in particular with needle (N) at the top or with needle (N) in the textile structure (T), or an adjustment of a stitch frequency (f) of the needle (N) depending on the condition, in particular the fabric structure or the color structure, the end or edge, the bead, the fabric defect or the fabric damage, or the speed of the moved flat section (T1) of the textile structure (T).

When the machine stops with the needle at the top, the textile structure can then be shifted or moved away from the stitch plate, while when the machine stops with the needle in the textile structure, the textile structure can be rotated around the needle. This facilitates sewing, embroidering or quilting.

Preferably, the needle stitch frequency (f) is adjusted to the speed (vector) or the absolute speed value (v) in such a way that the instantaneous needle stitch frequency (f) remains essentially proportional to the instantaneous speed (vector) or the instantaneous absolute speed value (v) of the textile structure (T). Preferably, a proportionality factor between the needle stitch frequency (f) and the speed (v) is set as required.

This ensures that the product of sewing, embroidering or quilting has a uniform stitch length even if the speed of movement of the textile structure is uneven during sewing, embroidering or quilting.

This adjustability allows products with small and large stitch lengths to be produced without changing the movement speed of the textile structure during sewing, embroidering or quilting. This adjustability also makes sewing, embroidering or quilting easier for beginners.

BRIEF DESCRIPTION OF THE DRAWINGS

Further advantages, features, and possible applications of the invention are apparent from the following description of a non-limiting embodiment with reference to the drawing, wherein.

DETAILED DESCRIPTION

Figure 1:
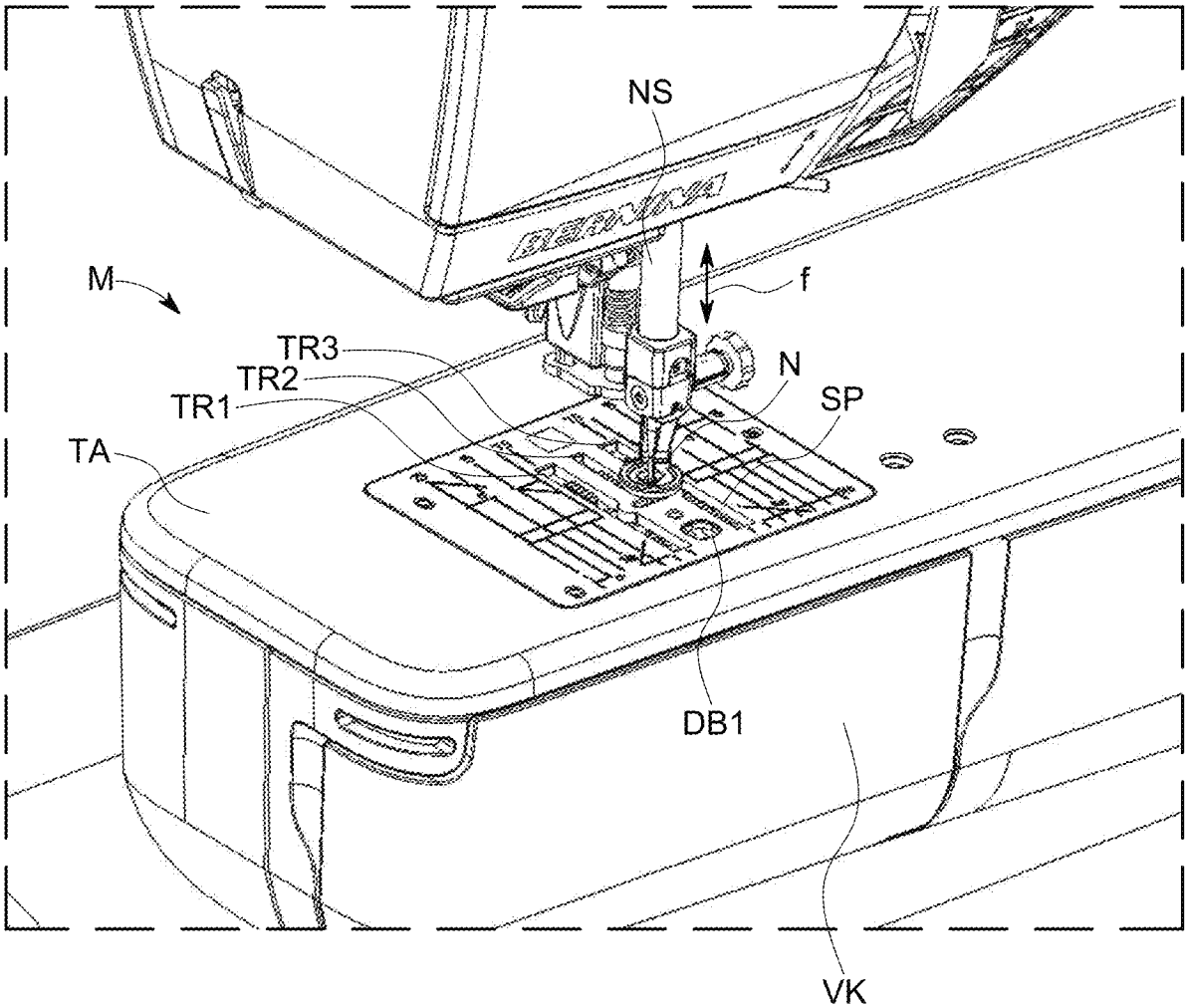
FIG. 1 shows a perspective view of a section of a sewing machine according to the invention with an upper part and a lower part in a first state (view from the front left)

FIG. 1 shows a perspective view (viewed from the front left) of a section of a sewing machine M according to the invention with an upper part and a lower part in a first state.

In the upper part of the machine, a needle bar NS can be seen above a stitch plate SP, which can be moved up and down and to which a needle N is attached, which has an eye for receiving an upper thread. The needle plate SP has an opening or recess A0 (see FIG. 4) for the needle N and the eye to pass through the needle plate SP from top to bottom and back from bottom to top.

The machine M also contains, in the lower part of the machine behind a closure flap VK and concealed by this, a rotatable or reciprocating gripper system GS (see FIG. 2, FIG. 3, FIG. 9) arranged below the stitch plate SP, to which gripper system a gripper (not shown) is attached, which has a gripper tip for picking up the upper thread.

A flat section T1 of a textile structure T (see FIG. 10) can be pressed in a stretched state against a textile structure support area TA adjacent to the stitch plate SP and/or against the stitch plate SP and thereby moved in a plane parallel to the stitch plate SP at a speed v (see FIG. 10) relative to the stitch plate SP. The flat section T1 lies flat against the stitch plate SP.

The machine M also contains a detector module DM (see FIGS. 3, 4, 5, 8, 10) with which a property and/or a state of the moved flat section T1 of the textile structure T (see FIG. 10) can be detected.

The machine M also contains a control unit SE or detector module control unit SE1 (see FIG. 8) with which an operating mode of the machine M can be adjusted depending on the detected property or the detected state of the moved flat section T1 of the textile structure T.

The detector module DM (see FIGS. 3, 4, 10) is arranged in an area below the stitch plate SP and next to the gripper system GS (see FIG. 3).

A double arrow next to the needle bar NS indicates the upward and downward movement of the needle bar NS and the needle N attached to it, in particular a cyclic movement with a frequency f.

A first row of feed dogs TR1, a second row of feed dogs TR2, and a third row of feed dogs TR3 can also be seen in the stitch plate SP.

A passage area DB1 can also be seen, through which an electromagnetic signal can pass from bottom to top and from top to bottom through the needle plate SP.

Figure 2:
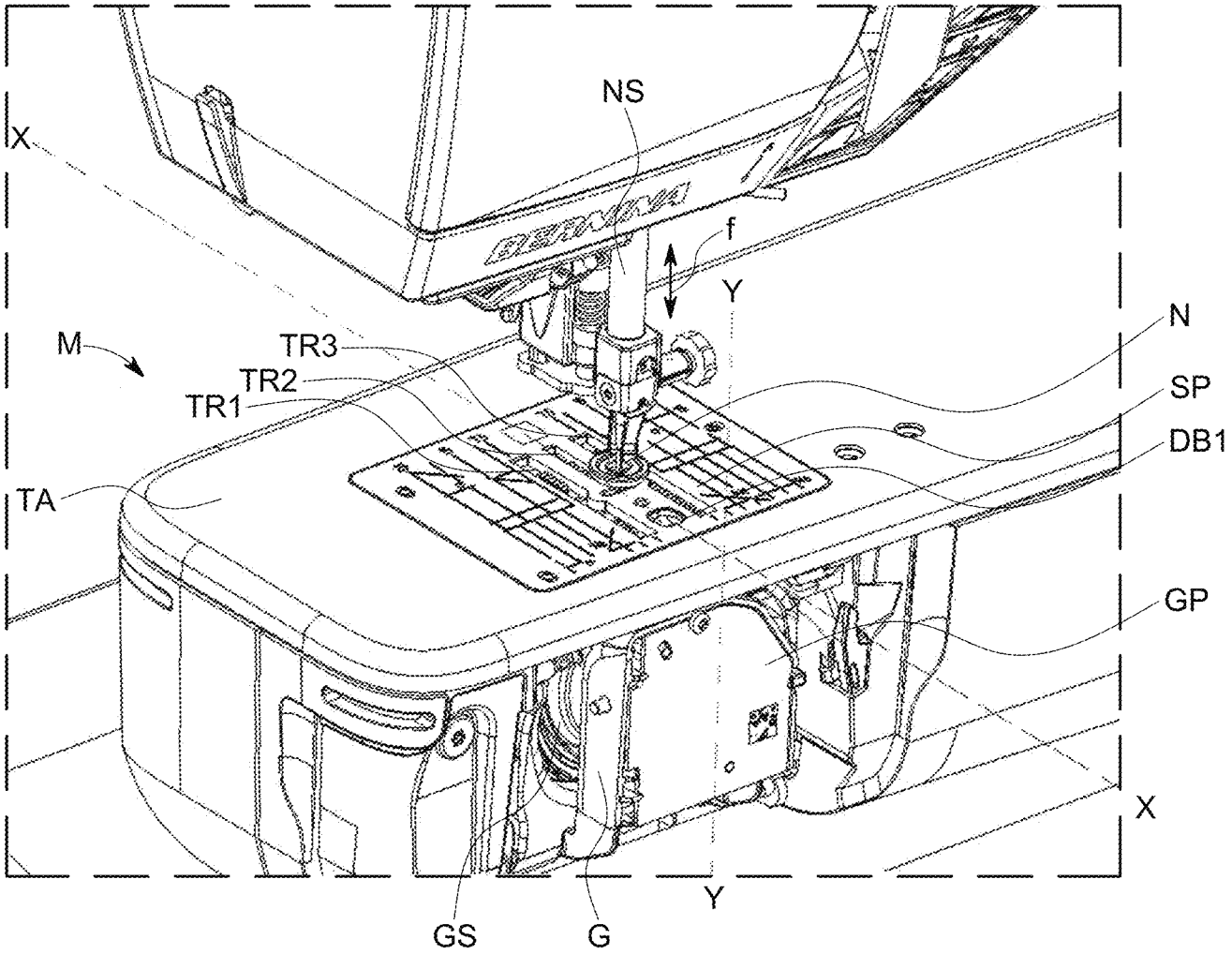
FIG. 2 shows a perspective view of the section of the sewing machine according to the invention in a second state, in which the lower part is open (view also from the front left)

FIG. 2 shows a perspective view (viewed from the front left) of a subassembly of the sewing machine M according to the invention in a second state, in which the lower part is opened by folding down the closure flap VK.

FIG. 2 differs from FIG. 1 only in that elements of the lower part that were concealed by the raised closure flap VK in FIG. 1 are now visible.

All elements of FIG. 1 shown by the reference symbols in FIG. 1 correspond to the elements of FIG. 2 shown by the same reference symbols in FIG. 2.

Figure 6:
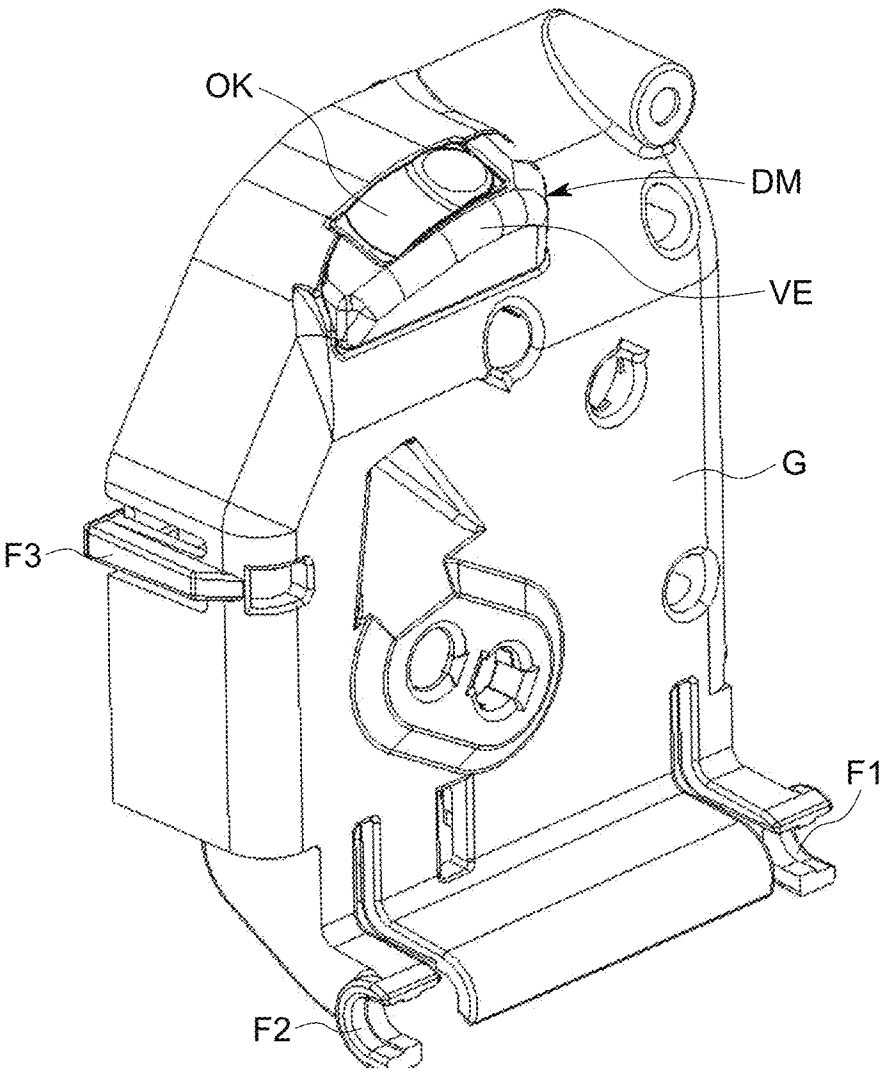
FIG. 6 shows another perspective view of the second, lower of the two assemblies of FIG. 4 from a different viewing direction.
Figure 7:
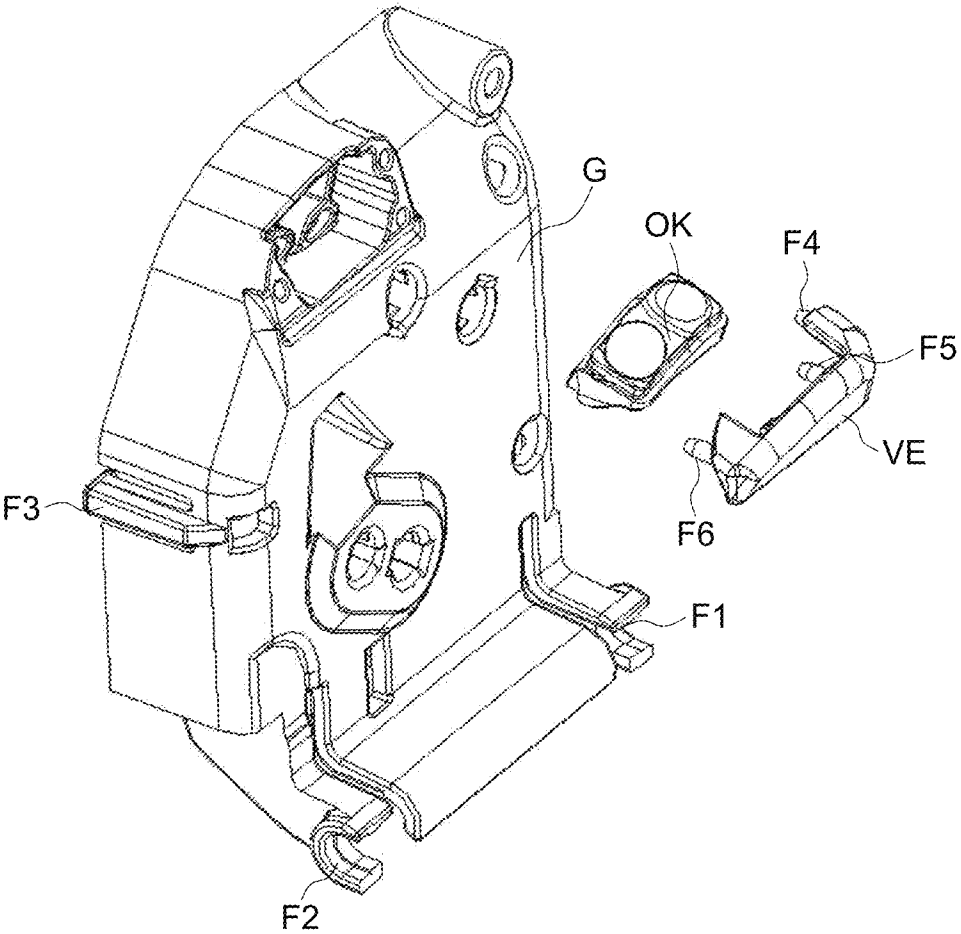
FIG. 7 shows a perspective view of the second, lower of the two assemblies of FIG. 4 in a partially disassembled state (exploded view)
Figure 8:
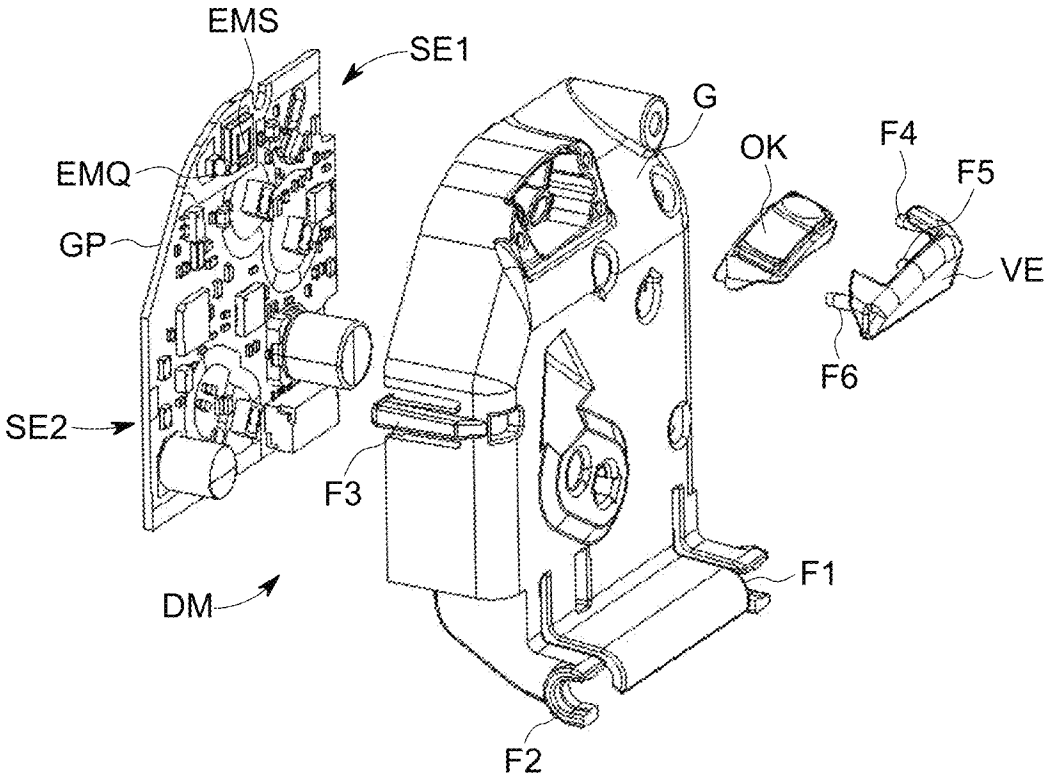
FIG. 8 shows a perspective view of the second, lower of the two assemblies of FIG. 4 in a further disassembled state (exploded view)

FIG. 2 also shows a housing G containing the detector module DM (see FIGS. 6, 7, and 8). A gripper system GS partially concealed by the housing G is also visible.

The housing G also contains a common circuit board GP or a common circuit board GP that forms part of the housing G. The detector module control unit SE1 and a lower thread monitoring unit SE2 are arranged side by side on the common circuit board GP (see FIG. 8).

Figure 3:
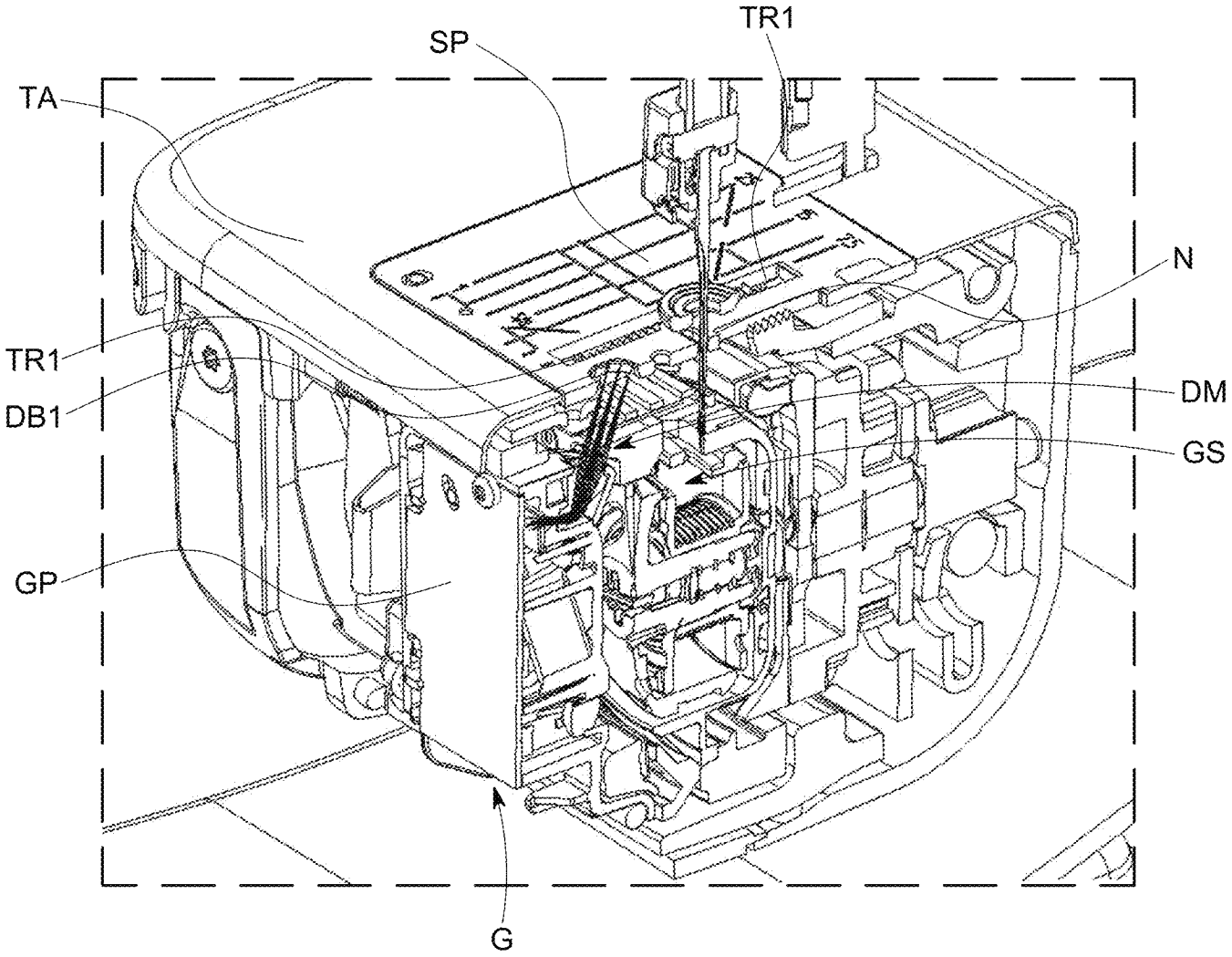
FIG. 3 shows a further perspective view of the lower open part of the sewing machine according to the invention, cut along a vertical xy plane (see FIG. 2) (view from the front right)

FIG. 3 shows another perspective view (this time from the front right) of the lower open part of the sewing machine M according to the invention, cut along a vertical xy plane (see FIG. 2).

All elements of FIG. 1 and FIG. 2 shown by the reference symbols in FIG. 1 and FIG. 2 correspond to the elements of FIG. 3 shown by the same reference symbols in FIG. 3.

FIG. 3 also shows a beam path within the detector module DM, schematically represented by dark lines.

The beam path represents, on the one hand, an electromagnetic signal S1 (see FIG. 10) emitted by an E/M source EMQ (e.g. light-emitting diode or laser diode, see FIG. 8), which can pass through the passage area DB1 of the stitch plate SP to a lower side of the textile structure T facing the stitch plate SP.

The beam path also represents an electromagnetic return signal S2 (see FIG. 10) reflected or scattered from the underside of the textile structure T, which is absorbed by an E/M sensor EMS (e.g. CCD sensor, CMOS sensor, FIG. 8).

Figure 4:
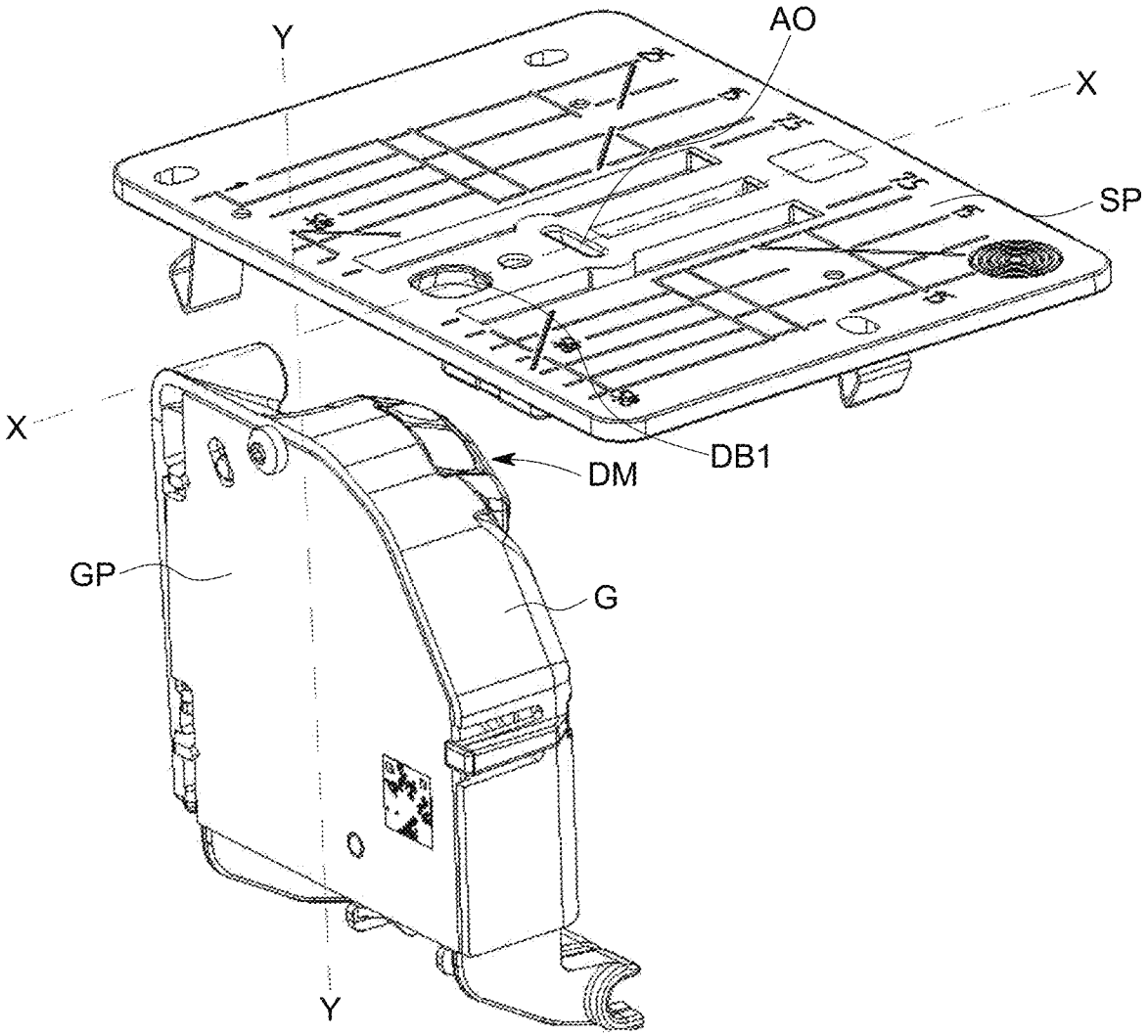
FIG. 4 shows a perspective view of two assemblies of the sewing machine according to the invention in their relative positions (without other parts of the sewing machine)

FIG. 4 shows a perspective view of two assemblies of the sewing machine M according to the invention in their relative positions (without other parts of the sewing machine).

The first, upper assembly is the stitch plate SP. It contains the opening or recess A0 for the needle N to pass through the stitch plate SP. It also contains the passage area DB1 for the passage of the forward signal S1 and the reverse signal S2.

The second, lower assembly is the housing G with the common circuit board GP, on which the E/M source EMQ (e.g. light-emitting diode or laser diode) and the E/M sensor EMS (e.g. CCD sensor, CMOS sensor) as well as the detector module control unit SE1 and the lower thread monitoring unit SE2 are arranged side by side (see FIG. 8).

Figure 5:
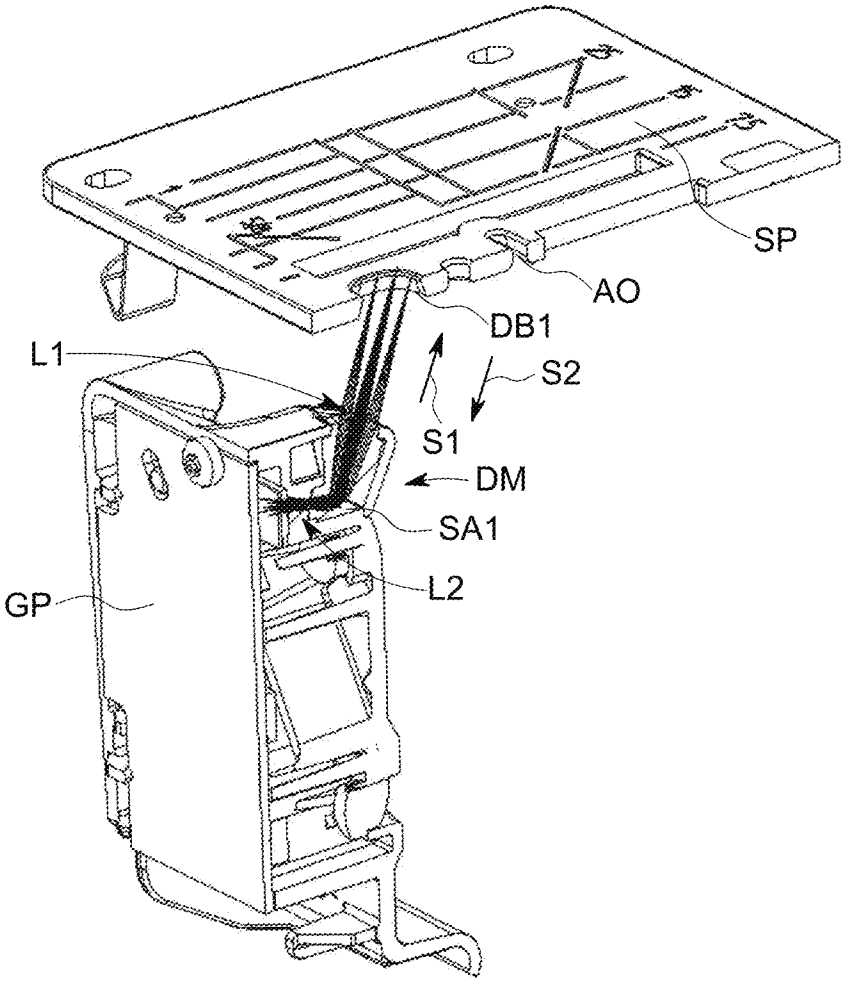
FIG. 5 shows a perspective view of the two assemblies of the sewing machine according to the invention in their relative positions (without other parts of the sewing machine), cut along a further vertical xy plane (see FIG. 4)

FIG. 5 shows a perspective view of the two assemblies of the sewing machine M according to the invention, cut along a further vertical xy plane (see FIG. 4), in their relative positions (without other parts of the sewing machine).

The forward signal S1 of the beam path can be seen between the E/M source EMQ (e.g. light-emitting diode or laser diode, see FIG. 8) and the passage area DB1, and the return signal S2 of the beam path can be seen between the passage area DB1 and the E/M sensor EMS (e.g. CCD sensor, CMOS sensor, FIG. 8).

The beam path passes through a first lens L1, a deflection area (mirror) AB, and a second lens L2.

The beam path also contains a field stop or diaphragm with an aperture (not shown), in particular a field of view stop and/or light field stop, and a stray light stop or diaphragm with an aperture (not shown).

FIG. 6 shows another perspective view of the second, lower assembly or housing G from FIG. 4 from a different viewing angle.

An optical capsule OK or an optical block integrated in the upper part of the housing G can be seen, in which the optical elements that are traversed by the beam path are contained. The optical capsule OK or the optical block is fixed to the housing G by means of a locking element VE in a defined position relative to the common circuit board GP.

The optics contained in the optical capsule OK or the optical block, together with the E/M source EMQ, the E/M sensor EMS and the detector module control unit SE1 on the common circuit board GP (see FIG. 8), form the detector module DM.

The housing G also contains formations F1, F2, F3, which, together with complementary formations (not shown) of the sewing machine M, enable the housing G to be fitted into the sewing machine M.

FIG. 7 shows a perspective view of the second, lower of the two assemblies from FIG. 4 in a partially disassembled state (exploded view).

The optical capsule OK or the optical block and the locking element VE can be seen separately from the housing G. The locking element VE has formations F4, F5, F6, which, together with complementary formations (not shown) of the housing G, enable the optical capsule OK or the optical block to be fitted into the housing G.

FIG. 8 shows a perspective view of the second, lower of the two assemblies from FIG. 4 in an even more disassembled state (exploded view).

All elements of FIGS. 6 and 7 shown by the reference symbols in FIGS. 6 and 7 correspond to the elements of FIG. 8 shown by the same reference symbols in FIG. 8.

FIG. 8 also shows, separate from the housing G, the common circuit board GP, on which the E/M source EMQ (e.g. light-emitting diode or laser diode) and the E/M sensor EMS (e.g. CCD sensor, CMOS sensor) as well as the detector module control unit SE1 and the lower thread monitoring unit SE2 are arranged next to each other.

Figure 9:
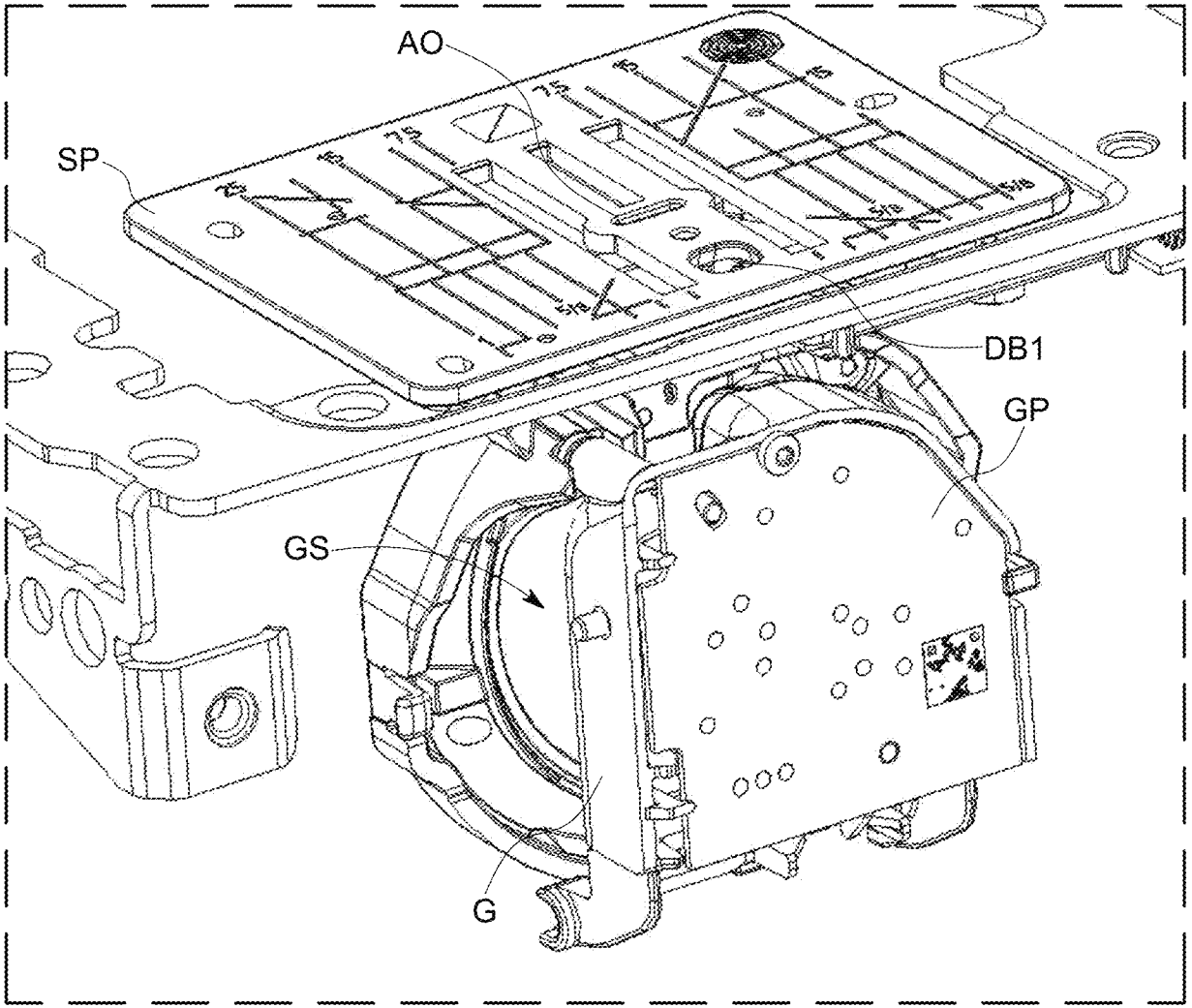
FIG. 9 shows a perspective view of the two assemblies of FIG. 4 and a further, third assembly in their relative positions.

FIG. 9 shows a perspective view of the two assemblies from FIG. 4 and a third assembly in their relative positions.

The first assembly is the stitch plate SP with its opening or recess A0 for the passage of the needle N and with its passage area DB1 for the passage of the forward signal S1 and the return signal S2.

The second assembly is the housing G with its common circuit board GP, of which only the rear side facing away from the assembled side is visible.

Finally, the third assembly is a gripper system GS (without gripper/not shown). Similar to FIG. 2, the gripper system GS in FIG. 9 is partially concealed by the housing G.

Figure 10:
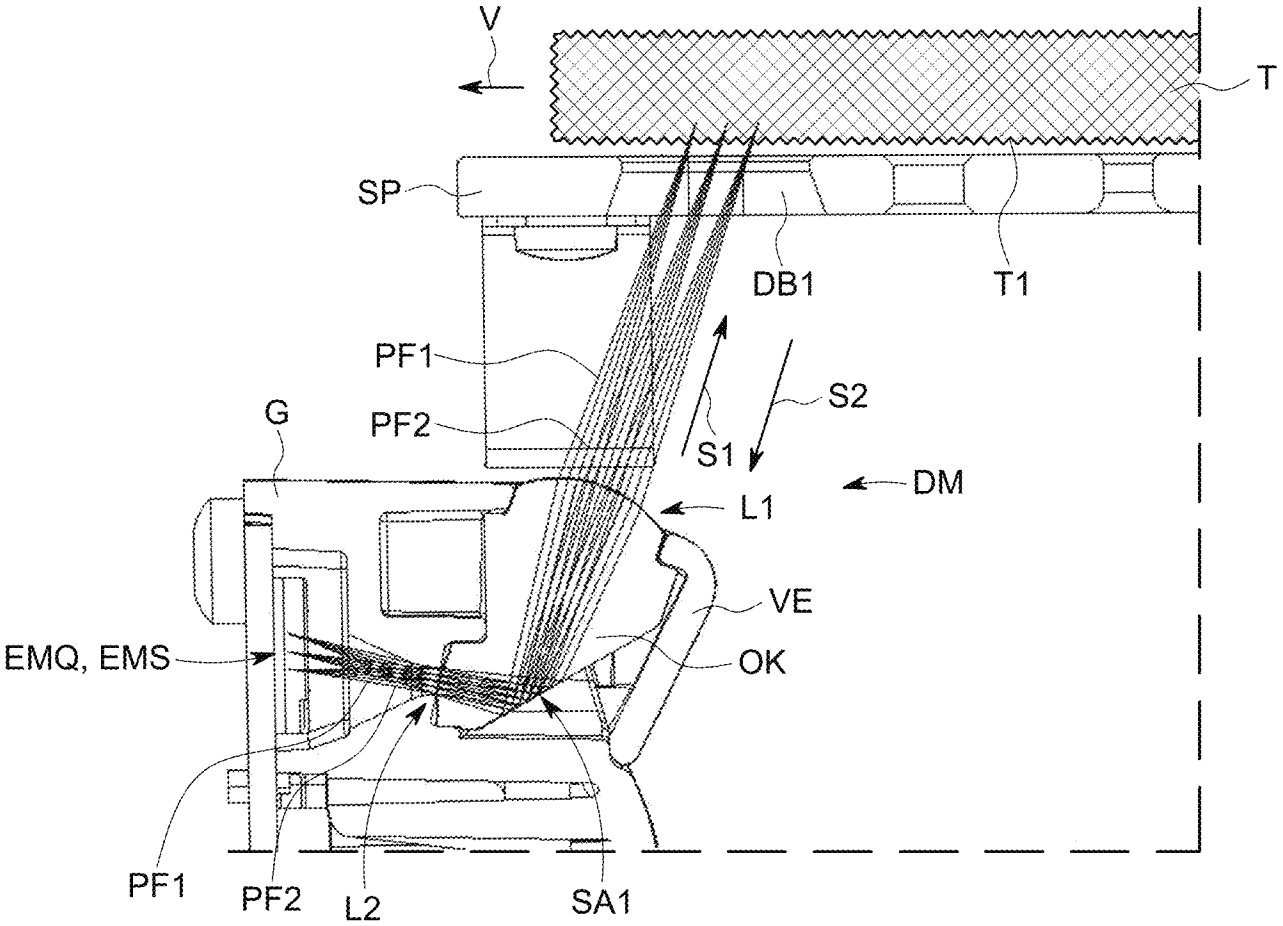
FIG. 10 shows an enlarged sectional view of part of the two cut assemblies of FIG. 5 with a view orthogonal to the vertical xy sectional plane of FIG. 4 and a textile structure in its intended use.

FIG. 10 shows an enlarged sectional view of part of the two cut assemblies from FIG. 5, viewed orthogonally to the vertical xy sectional plane of FIG. 4, as well as a textile structure T in normal operation.

The sectional view shows the stitch plate SP with its passage area DB1 and the textile structure T1 on the stitch plate SP.

A flat section T1 of the textile structure T is pressed against the stitch plate SP in a more or less stretched state and moved in a plane parallel to the stitch plate SP at a speed v relative to the stitch plate SP.

In the beam path, a forward propagation path PF1 corresponding to the forward signal S1 and a backward propagation path PF2 corresponding to the backward signal S2 can be seen.

In addition, the optical capsule OK or the optical block, which is arranged to fit precisely in a defined position in the housing G, can be seen in sectional view, as can the locking element VE, which locks the optical capsule OK or the optical block in its position in the housing G.

The optical capsule OK or the optical block contains a first lens L1, a beam deflecting means SA1 (mirror) and a second lens L2. In the optical block variant, the optical block consists of a light-transmissive material, in particular glass or a polymer. The optical block thus forms a monoblock made of glass or polymer. The beam deflecting means SA1 is formed by a totally reflective boundary surface between the light-transmitting material and the atmospheric air.

The optics contained in the optical capsule OK enable, on the one hand, the illumination of the flat section T1 of the underside of the textile structure T by the E/M source EMQ via the forward propagation path PF1 and, on the other hand, the optical imaging of object points of the flat section T1 of the underside of the textile structure T via the backward propagation path PF2 onto image points on the E/M sensor EMS.

Figure 11:
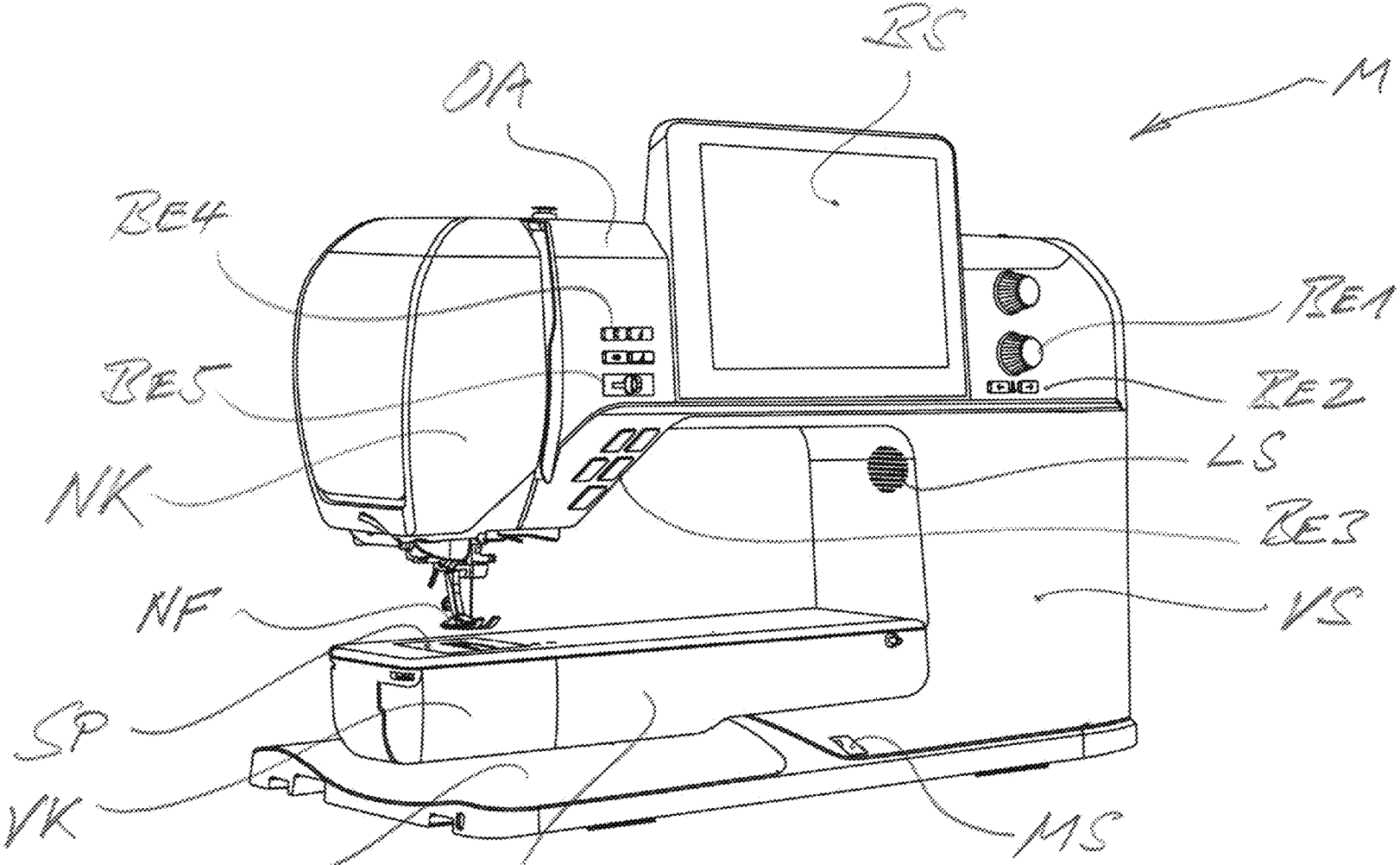
FIG. 11 shows an overall perspective view of a sewing machine according to the invention, in which the part framed by the dashed lines corresponds to the view in FIG. 1.

FIG. 11 shows an overall perspective view of a sewing machine M according to the invention, in which the part framed by the dashed lines corresponds to the view in FIG. 1.

The sewing machine M essentially comprises a base plate BP, a vertical column VS extending upward from the base plate BP, a lower arm UA extending horizontally from a lower region of the vertical column VS, and an upper arm OA extending from an upper region of the vertical column VS.

A stitch plate SP and a shutter flap/closure cap VK can be seen at the free end of the lower arm UA. A sewing head NK is located at the free end of the upper arm OA.

At the lower end of the sewing head NK in the upper part of the machine M, the needle bar NS can be seen which can be moved up and down and to which the needle N is attached which has an eye for receiving an upper thread (see FIG. 2). A presser foot NF can also be seen.

Behind the shutter flap/closure cap VK in the lower part of the sewing machine M and below the stitch plate SP, the rotatable or reciprocating gripper system GS (see FIG. 2) is located.

A loudspeaker LS is located in the upper part of the vertical column VS, and a screen/display BS is located in the center of the upper arm OA. A mechanical interface MS can also be seen in the base plate BP, to which a knee lever (not shown) can be connected to operate the machine M.

A first type of control element BE1 in the form of a first and a second rotary knob is arranged on the upper part of the vertical column VS. A second type of control element BE2 in the form of a first and a second push button is also arranged on the upper part of the vertical column VS below the first type of control element BE1.

A third type of control element BE3 in the form of five push buttons, a fourth type of control element BE4 in the form of four push buttons, and a fifth type of control element BE5 in the form of a slide are arranged on the upper arm OA to the right of the sewing head NK.

LIST OF REFERENCE SYMBOLS

- M machine for sewing, embroidery or quilting
- NK sewing head
- VS vertical column
- OA upper arm
- UA lower arm
- VK shutter flap/closure cap
- NF presser foot
- BP base plate
- BS screen/display
- MS mechanical interface
- BE1 first type of control element/rotary knob
- BE2 second type of control element/push button
- BE3 third type of control element/push button
- BE4 fourth type of control element/push button
- BE5 fifth type of control element/slide
- LS loudspeaker
- SP stitch plate (or: needle plate)
- TA fabric structure support area (adjacent to the stitch plate)
- NS needle bar
- GS gripper system (or: hook system
- A0 opening/recess in the stitch plate (needle passage and/or DM signal passage)
- DB1 passage area of the stitch plate (DM signal passage)
- DB2 passage area of the stitch plate (DM signal passage)
- N needle with eye
- G housing
- F1 first formation
- F2 second formation
- F3 third formation
- VK shutter flap
- T textile structure
- T1 flat section of the textile structure
- DM detector module (EMQ, EMS and optics)
- SE control unit
- EMQ E/M source (light source, LED, laser)
- EMS E/M sensor (CCD sensor, CMOS sensor)
- S1 forward signal (from EMQ to the moved textile structure)
- S2 return/backward signal (from the moved textile structure back to EMS)
- PF1 forward propagation path PF2 return/backward propagation path
V (amount of) speed of the textile structure relative to the stitch plate
f stitch frequency of the needle
SE1 detector module control unit
SE2 additional control unit/lower thread monitoring unit
GP common circuit board
TR1 first conveyor row/first feed dog row
TR2 second conveyor row/second feed dog row
TR3 third conveyor row/third feed dog row
OK optical capsule or optical block
SA1 (first) beam deflecting means
L1 first lens
L2 second lens
VE locking element
F4 fourth formation
F5 fifth formation
F6 sixth formation

The invention claimed is:

1. A machine (M) for sewing, embroidering or quilting, comprising:

a needle bar (NS) arranged above a stitch plate (SP) and movable up and down and to which needle bar a needle (N) is attached, which has an eye for receiving an upper thread;

a rotatable or reciprocating gripper system (GS) arranged below the stitch plate (SP) and to which gripper system a gripper is attached, the gripper has a gripper tip for picking up the upper thread;

wherein the stitch plate (SP) contains an opening or recess (A0) for the needle (N) and the eye to pass through the stitch plate (SP) from top to bottom and back, and wherein a flat section (T1) of a textile structure (T) in a stretched state is adapted to be pressed against a textile structure support area (TA) adjacent to the stitch plate (SP) and/or against the stitch plate (SP) and moved in a plane parallel to the stitch plate (SP) at a speed (v) relative to the stitch plate (SP), so that the flat section (T1) lies flat against the stitch plate (SP);

a detector module (DM) configured to detect a property and/or a state of the moved flat section (T1) of the textile structure (T), the detector module (DM) comprises an E/M source (EMQ) which is adapted to emit an electromagnetic signal (S1) which can pass through the textile structure support area (TA) and/or the stitch plate (SP) at a first passage area (DB1) of the textile structure support area (TA) and/or the stitch plate (SP) to a lower side of the flat section (T1) of the textile structure (T) facing the textile structure support area (TA) and/or the stitch plate (SP) and is adapted to be irradiated onto a lower side of the flat section (T1) of the textile structure (T) in order to generate an electromagnetic return signal (S2) reflected or scattered by an underside of the moved flat section (T1), and an E/M sensor (EMS) which is adapted to absorb the electromagnetic return signal (S2) reflected back or scattered from the underside of the moved flat section (T1) and scattered by the underside of the moved flat section (T1) and which is adapted to pass through the textile structure support area (TA) and/or the stitch plate (SP) at the first passage area (DB1) or at a second passage area of the textile structure support area (TA) and/or the stitch plate (SP) to the E/M sensor (EMS); and a control unit (SE) configured to adjust an operating mode of the machine (M) depending on the detected property and/or the detected state of the moved flat section (T1) of the textile structure (T);

wherein at least one of:

a) a distance measured along an upper surface of the textile structure support area (TA) and/or the stitch plate (SP) between the opening/recess (A0) for the passage of the needle (N) and the first passage area (DB1) is less than 30 mm; or b) the passage area (DB1 and/or DB2) is located between two adjacent rows of feeders/conveyors or feed dogs (TR1, TR2, TR3) of the stitch plate (SP).

2. The machine according to claim 1, wherein the detector module (DM) is arranged in an area below the stitch plate and/or flush with the upper surface of the stitch plate (SP).

3. The machine according to claim 2, wherein the detector module (DM) is arranged next to the gripper system (GS).

4. The machine according to claim 1, wherein the detector module (DM) is configured to detect a fabric property and a speed or deformation of the moved flat section (T1) of the textile structure (T).

5. The machine according to claim 4, wherein the fabric property is a fabric structure or a color structure, an end or an edge, a bulge, a fabric defect or fabric damage.

6. The machine according to claim 4, wherein the control unit (SE) or detector module control unit (SE1) is adapted to effect at least a machine stop and/or an adjustment of a stitch frequency (f) of the needle (N) in dependence on the fabric property and/or the speed of the moved flat section (T1) of the textile structure (T).

7. The machine according to claim 6, wherein the machine stop is with the needle (N) at a top location or with the needle (N) in the textile structure (T).

8. The machine according to claim 1, further comprising at least one first beam deflecting means (SA1) arranged as a component of the detector module (DM) in a forward propagation path (PF1) of the forward signal (S1) extending from the E/M source (EMQ) to the underside of the flat sub-area (T1); and/or at least one second beam deflecting means arranged as a component of the detector module (DM) in a return propagation path (PF2) of the return signal (S2) extending from the underside of the flat section (T1) to the E/M sensor (EMS).

9. The machine according to claim 8, wherein the forward propagation path (PF1) and/or the return propagation path (PF2) has at least one baffle or diaphragm with an aperture.

10. The machine according to claim 9, wherein the forward propagation path (PF1) and the return propagation path (PF2) are identical or congruent at least along a common section along the forward propagation path (PF1) and along the return propagation path, and the forward signal (S1) is adapted to pass through a partial region in a first direction and the return signal (S2) is adapted to pass through a partial region (TPF) in a second direction.

11. The machine according to claim 1, wherein at least one of:

a) the first passage area (DB1) and/or a second passage area are formed by an opening in the textile structure support area (TA) adjacent to the stitch plate (SP) and/or in the stitch plate (SP) which opening is permeable/transmissible to the first signal (S1) and to the second signal (S2);

b) the first passage area (DB1) and/or the second passage area are formed by a window in the textile structure support area (TA) adjacent to the stitch plate (SP) and/or in the stitch plate (SP) which window is permeable/transmissible to the first signal (S1) and to the second signal (S2); or c) the textile structure support area (TA) adjacent to the stitch plate (SP) and/or the stitch plate (SP) is formed from a material that is permeable/transmissible to the first signal (S1) and to the second signal (S2).

12. The machine according to claim 1, wherein the detector module (DM) has a housing (G) in which components of the detector module (DM) are arranged.

13. The machine according to claim 1, wherein the forward propagation path (PF1) and the backward propagation path (PF2) pass through an optical capsule (OK) or an optical block, respectively, and the optical capsule (OK) or the optical block has at least one lens (L1, L2) and at least one beam deflecting means (SA1).

14. The machine according to claim 13, wherein the optical block is formed from a monoblock made of light-transmissive material, and the at least one beam deflecting means (SA1) is preferably a totally reflective boundary surface or interface between a light-transmitting material of the monoblock and the atmospheric air, and the at least one lens (L1, L2) is a curved surface of the monoblock made of the light-transmitting material.

15. A method for sewing, embroidering or quilting using a machine (M), the method comprising:

a) moving up and down a needle bar (NS) arranged above a stitch plate (SP), to which a needle (N) is attached, which has an eye with an upper thread received therein, wherein the needle (N) and the eye with the upper thread are repeatedly moved up and down from above to below and back through an opening or recess (A0) of the stitch plate (SP);

b) simultaneously and synchronized with the upward and downward movement of the needle bar (NS), rotating or reciprocating a gripper system (GS) arranged below the stitch plate (SP), to which a gripper is attached which has a gripper tip, the gripper system providing a lower thread and the gripper picking up the upper thread with the gripper tip and brings the upper thread together with the lower thread;

c) simultaneously moving a flat section (T1) of a textile structure (T) in a stretched state and pressed against a textile structure support area (TA) adjacent to the stitch plate (SP) and/or against the stitch plate (SP) in a plane parallel to the stitch plate (SP) at a speed (v) relative to the stitch plate (SP), so that the flat section (T1) lies flat against the stitch plate (SP), forming stitches joining the upper thread and the lower thread on the textile structure (T);

d) detecting a property and/or a state of the moved flat section (T1) of the textile structure (T) by a detector module (DM), wherein the detector module (DM) comprises an E/M source (EMQ) which is adapted to emit an electromagnetic signal (S1) which can pass through the textile structure support area (TA) and/or the stitch plate (SP) at a first passage area (DB1) of the textile structure support area (TA) and/or the stitch plate (SP) to a lower side of the flat section (T1) of the textile structure (T) facing the textile structure support area (TA) and/or the stitch plate (SP) and is adapted to be irradiated onto a lower side of the flat section (T1) of the textile structure (T) in order to generate an electromagnetic return signal (S2) reflected or scattered by an underside of the moved flat section (T1), and an E/M sensor (EMS) which is adapted to absorb the electromagnetic return signal (S2) reflected back or scattered from the underside of the moved flat section (T1) and scattered by the underside of the moved flat section (T1) and which is adapted to pass through the textile structure support area (TA) and/or the stitch plate (SP) at the first passage area (DB1) or at a second passage area of the textile structure support area (TA) and/or the stitch plate (SP) to the E/M sensor (EMS; and e) adapting an operating mode of the machine (M), depending on the detected property and/or the detected state of the moved flat section (T1) of the textile structure (T) by a control unit (SE);

wherein at least one of:

a) a distance measured along an upper surface of the textile structure support area (TA) and/or the stitch plate (SP) between the opening/recess (A0) for the passage of the needle (N) and the first passage area (DB1) is less than 30 mm; or b) the passage area (DB1 and/or DB2) is located between two adjacent rows of feeders/conveyors or feed dogs (TR1, TR2, TR3) of the stitch plate (SP).

16. The method according to claim 15, wherein the property of the moved flat textile structure (T) has at least one of the following aspects: a texture, a fabric structure, a color structure, an end or an edge, a bulge, a fabric defect or damage to the textile structure (T).

17. The method according to claim 15, wherein the state of the moved flat textile structure (T) has at least one of the following aspects: a speed, a deformation, or an elongation.

18. The method according to claim 15, further comprising the control unit (SE) or a detector module control unit (SE1) causing at least one of a machine stop or an adjustment of a stitch frequency (f) of the needle (N) depending on the property and/or the condition of the moved flat section (T1) of the textile structure (T).

* * * * *